US007900707B2

(12) United States Patent
Shotter et al.

(10) Patent No.: US 7,900,707 B2
(45) Date of Patent: Mar. 8, 2011

(54) APPARATUS AND METHOD FOR SELECTIVELY CONTROLLING FLUID DOWNHOLE IN CONJUNCTION WITH A PROGRESSIVE CAVITY PUMP (PCP)

(75) Inventors: Paul Shotter, Aberdeen (GB); Andrew Leitch, Aberdeen (GB)

(73) Assignee: Rmspumptools Limited (GB)

( * ) Notice: Subject to any disclaimer, the term of this patent is extended or adjusted under 35 U.S.C. 154(b) by 413 days.

(21) Appl. No.: 11/841,335

(22) Filed: Aug. 20, 2007

(65) Prior Publication Data

US 2008/0041477 A1 Feb. 21, 2008

(30) Foreign Application Priority Data

Aug. 19, 2006 (GB) ..... 0616555.9

(51) Int. Cl.
*E21B 33/00* (2006.01)
*E21B 34/00* (2006.01)
*E21B 43/00* (2006.01)

(52) U.S. Cl. ..... 166/373; 166/332.1; 166/105; 166/68.5; 166/68

(58) Field of Classification Search ..... 166/332.1, 166/381, 69, 374, 373, 68.5, 332.5, 330, 166/332.4, 68; 417/360, 423.3, 424.2, 358
See application file for complete search history.

(56) References Cited

U.S. PATENT DOCUMENTS

| | | | | |
|---|---|---|---|---|
| 3,552,718 | A * | 1/1971 | Schwegman | 251/291 |
| 5,549,160 | A * | 8/1996 | Bownes et al. | 166/250.08 |
| 5,871,051 | A * | 2/1999 | Mann | 166/377 |
| 6,089,832 | A * | 7/2000 | Patterson | 417/360 |
| 6,557,639 | B1 | 5/2003 | Matthews et al. | |
| 6,729,391 | B2 * | 5/2004 | Hill et al. | 166/68.5 |
| 6,763,892 | B2 * | 7/2004 | Kaszuba | 166/373 |

FOREIGN PATENT DOCUMENTS

| | | | |
|---|---|---|---|
| GB | 2087957 | A | 6/1982 |
| GB | 2309470 | A | 7/1997 |
| GB | 2394488 | A | 4/2004 |
| GB | 2396633 | A | 6/2004 |
| WO | WO2006048629 | A1 | 5/2006 |

* cited by examiner

*Primary Examiner* — Jennifer H Gay
*Assistant Examiner* — Michael Wills, III
(74) *Attorney, Agent, or Firm* — Pepper Hamilton LLP

(57) ABSTRACT

An apparatus and a method for selectively controlling fluid flow. The apparatus includes a body member having a throughbore formed therein. The apparatus also includes at least one bypass port formed in the body member and a rotatable member arranged for insertion and rotation within the throughbore of the body member. The rotatable member in the throughbore creates first and second annular portions. The apparatus further comprises a moveable member, wherein the moveable member is moveable between a first configuration which defines a first fluid flow path between the first and second annular portions and a second configuration which defines a second fluid flow path between the first annular portion and the at least one bypass port. The moveable member is typically moveable between the first and second configurations in response to fluid flow along the first fluid flow path.

42 Claims, 8 Drawing Sheets

APPARATUS AND METHOD FOR SELECTIVELY CONTROLLING FLUID DOWNHOLE IN CONJUNCTION WITH A PROGRESSIVE CAVITY PUMP (PCP)

CROSS REFERENCE TO RELATED APPLICATION

This application claims the priority benefit of United Kingdom Patent Application No. GB0616555.9, titled "Apparatus and Method", filed Aug. 19, 2006.

BACKGROUND

The present invention relates to an apparatus and a method for selectively controlling fluid flow. In particular, the invention relates to an apparatus and method for use in downhole operations in the hydrocarbon production industry. The invention also relates to a progressive cavity pump comprising a fluid flow control apparatus.

During extraction of resources from beneath the surface of the earth and especially in the oil and gas exploration and production industry, it is often necessary to overcome a pressure differential (hydrostatic head) between a subterranean fluid reservoir and the surface. This can be achieved using a pump such as a progressive cavity pump (hereinafter a "PCP").

FIG. 1 is a cut away side view of part of a typical prior art PCP 12. PCPs 12 typically comprise a helical steel rotor 16 and a rubber stator 14 having a double screw profile matching the helical rotor 16. The stator 14 is formed to allow rotation of the inserted rotator 16 therein and this arrangement results in a series of cavities 18 along the length of the PCP 12 between the rotor 16 and the stator 14. The stator 14 is usually encapsulated within a tubing section (not shown) that typically forms part of a tubing string running from the reservoir to the surface. The rotor 16 is typically connected to a rod string (not shown) having a smaller diameter than the tubing string where the rod string is admitted within the throughbore of the tubing string and positioned such that the rotor 16 is located within the stator 14. The rod string is then connected to a rotary motor at the surface to power rotation of the rod string and attached rotor 16 at the appropriate speed.

When the PCP 12 is in use, rotation of the rotor 16 within the stator 14 creates a positive displacement that causes fluids in the cavities 18 to progress upwards due to a gradual build-up of pressure from the inlet to the discharge of the PCP 12. The build-up of pressure causes positive displacement of fluid within the cavities 18 and provides the necessary lift to extract fluid from the reservoir and pump it towards the surface thereby overcoming the hydrostatic head.

PCPs 12 are often used in wells that produce high quantities of sand along with the produced fluids due to the material selection of the pump 12 and use of the rubber stator 14 against the steel rotor 16, PCPs 12 are also suitable for production of heavy hydrocarbons and are commonly used in wells for extraction of high viscosity fluids. An important factor in determining the lifetime of the PCPs 12 is the quantity of sand and solids present in the hydrocarbon and fluid mixture passing through the pump 12.

Stopping operation of the PCP 12 can result in the sand (that is entrained in fluids within the production tubing above the PCP 12 having already been pumped) settling above the stator 14 and creating a sand plug in the tubing string. Once the PCP 12 is restarted, the rotor 16 may run dry within the stator 14 for a period of time until the requisite pressure accumulates to blast away the sand plug. During this period, the PCP 12 rotor 16 running dry within the stator 14 can tear up or otherwise cause severe damage to the stator 14 resulting in destruction of the pump 12. The PCP system would then require replacement with the associated high cost due to lengthy down time and loss of well production. Conventionally, this situation is avoided by dissipating the sand plug using a rig to pull the rod string and attached rotor 16 out of the stator 14. Sand can then fall through the stator 14 and out of the lower end of the pump 12 after which the rod string and attached rotor 16 can be repositioned within the stator 14. However, this operation is both costly and time consuming and results in undesirable downtime.

Since the PCP 12 is a positive displacement pump, there is no method for allowing fluids to free flow through the pump 12 from the reservoir to the surface in the event of pump 12 failure. Additionally, there is no method by which fluids from the surface can be forced into the reservoir through the pump 12 to conduct reservoir treatments. These operations are conventionally conducted by pulling the rod string and attached rotor 16 from the wellbore and allowing fluids to free flow through the stator 14. Again, this is a costly and time consuming operation and results in undesirable downtime.

SUMMARY

According to a first aspect of the present invention, there is provided an apparatus for selectively controlling fluid flow. The apparatus includes a body member having a throughbore formed therein, at least one bypass port formed in the body member, a rotatable member arranged for insertion and rotation within the throughbore of the body member thereby creating first and second annular portions, and a moveable member. The moveable member is moveable between a first configuration which defines a first fluid flow path between the first and second annular portions and a second configuration which defines a second fluid flow path between the first annular portion and each bypass port.

Typically, the moveable member is moveable between the first and second configurations in response to fluid flow along one of the fluid flow paths, preferably the first fluid flow path.

Preferably, the apparatus is downhole apparatus for controlling the flow of naturally produced fluids, injected fluids or pumped produced fluids.

According to the first aspect of the present invention, there is provided a method of controlling fluid flow. The method includes providing a body member having a bypass port and a throughbore, inserting a rotatable member within the throughbore of the body member and thereby providing a first fluid flow path between a first annular portion and a second annular portion between the body member and the rotatable member and a second fluid flow path between the first annular portion and the bypass port in the body member, and providing a moveable member that is moveable between a first configuration in which flow is directed along the first flow path and a second configuration in which flow is directed along the second flow path. The moveable member moves between the first and second configurations in response to fluid flow along the first fluid flow path.

Typically, fluid flow along the first fluid flow path is provided by a pump. Preferably, sufficient fluid flow along the first fluid flow path moves and maintains the moveable member in the first configuration and insufficient or no fluid flow along the first fluid flow path results in movement of the moveable member to, and maintenance in, the second configuration. When the moveable member is in the second configuration, fluid flow is directed along the second fluid flow path, where the fluid flow is driven typically as a result of relatively high reservoir pressures.

Preferably, the method is directed to controlling the flow of naturally produced fluids, injected fluids or pumped produced fluids downhole.

Preferably, the method of controlling flow of fluid comprises diverting flow of fluid between the first and second flow paths and preferably comprises permitting the moveable member to move in response to fluid flow conditions within a downhole wellbore.

Typically, the moveable member is moveable in response to a pressure differential within the throughbore. The moveable member can be moveable in response to a pressure differential between the first and second annular portions.

The movable member can be biased towards the second configuration. The movable member can be biased by a resilient means towards the second configuration.

Biasing the moveable member in the second configuration allows fluid in the throughbore above the apparatus to circumvent the second annular portion, should the pressure differential between the first and second annular portions be insufficient to overcome the biasing force of the resilient means.

The moveable member can translate between the first and the second configuration by movement in a direction substantially parallel to a longitudinal axis of the body member. The movable member can comprise a cylindrical sleeve coupled to an inner surface of the body member and movable relative thereto.

The moveable member can be arranged in the first configuration to permit fluid flow in the first fluid flow path and prevent fluid flow in the second fluid flow path. The moveable member can be adapted to open the bypass port(s) when in the second configuration and to obturate the bypass port(s) when in the first configuration. The moveable member can comprise a sleeve having one or more openings provided in the sidewall. The openings can be aligned with the bypass port(s) in the second configuration and the sidewall of the sleeve can obturate the bypass port(s) in the first configuration.

The moveable member can, in the second configuration, be adapted to permit fluid flow in the second fluid flow path and prevent fluid flow in the first fluid flow path. The moveable member can be adapted to close the annulus between the first and second annular portions when in the second configuration and can be adapted to permit fluid flow in the annulus between the first and second annular portions when in the first configuration.

The movable member can comprise a protrusion extending radially into the annulus. The rotatable member can comprise an enlarged portion such that translation of the moveable member into the second configuration comprises movement of the radial protrusion of the moveable member into contact with the enlarged portion of the rotatable member to substantially close the annulus therebetween. Preferably, the radial protrusion of the moveable member only permits flow of fluid through the second annular portion when the bypass port(s) is/are substantially obturated by the sidewall of the moveable member. Preferably the radial protrusion is arranged such that fluid flow can act on a face of the radial protrusion to maintain the movable member in the first configuration when the fluid exerts a force on the face that is above a predetermined force.

Preferably, the moveable member and the rotatable member are coupled to a pump such as a PCP. Preferably, the moveable member translates from the second configuration to the first configuration when the pump is activated and remains in the first configuration whilst the pump means remains in operation. The moveable member can be actuated to move from the first configuration to the second configuration when the pump is deactivated and can remain in the second configuration whilst the pump remains deactivated.

The rotatable member can be coupled at one end to a rotor for use in a progressive cavity pump. The other end of the rotatable member can be coupled to a motor for driving rotation of the rotatable member. An end of the body member can be coupled to tubing having a stator disposed therein.

Embodiments of the present invention have the advantage that the PCP pump does not have to blast away a solids or sand plug in the production tubing above the apparatus on reactivation. This is because no sand plug is created, since when the PCP is inactive, the moveable member can occupy the second configuration and the second fluid flow path is open allowing solids to settle outwith the tubing in which the rotor/stator of the PCP are located.

The method can include latching the rotatable member in a predetermined position relative to the body member.

The apparatus can further be provided with a latch device for correctly positioning between the rotatable member relative to the body member. The latch device can ensure the correct position of the enlarged portion relative to the radial protrusion and/or of the rotor relative to the stator. The latch device can comprise corresponding engagement portions provided on the body member and the rotatable member. The engagement portions can comprise intermitting splines. The rotatable member can be rotatable relative to the engagement portion provided on the rotatable member.

The engagement portion of the rotatable member can be provided on the enlarged portion. An inner surface of the body member can be provided with a fastener formed with corresponding engagement portions and having a throughbore for accommodating the rotatable member therebetween.

The rotatable member can also be provided with a driver for driving the engagement portions of the rotatable member and the body member into secure engagement with one another. The driver can comprise a rigid band attached to the rotatable member that is capable of contacting and driving the engagement portions into secure engagement. The driver can also be utilised to provide an indicator means for positioning the rotor correctly into the stator.

Preferably, the apparatus comprises a first sealing means that is adapted to seal the bypass port(s) from the first annular portion when the moveable member is in the first configuration. The apparatus can comprise a second sealing means that is adapted to seal the annulus between the first and second annular portions when the moveable member is in the second configuration.

The sealing means can comprise annular seals or annular sliding seals. The first sealing means can comprise at least one annular seal provided on each side of the bypass port(s) on an inner surface of the body member to seal against a surface of the moveable member. The second sliding seal can comprise an annular sealing means provided on an outer surface of the radial protrusion.

Alternatively, at least one of the first or second sealing means can comprise a pressure locked sleeve, such as those described in United Kingdom Patent No. GB2411416B, the full disclosure of which is incorporated herein by reference.

When in the second configuration, preferably, the bypass port(s) formed in the body member are adapted to encourage solids present in fluids downstream of the moveable member to settle out with the body member rather than the solids falling through the first and second annular portions to settle within the body member.

According to a second aspect of the invention, there is provided a body member for use with a rotatable member, wherein the body member has a throughbore for receiving a rotatable member and at least one bypass port formed through a sidewall of the body member; and wherein the body member is further provided with a moveable member that is moveable between a first configuration in which the bypass port(s) are substantially obturated and a second configuration in which the bypass port(s) are in fluid communication with the throughbore.

The moveable member can be coaxial with the body member and sealed thereagainst. The body member can be coupled to tubing having a stator for use in a PCP formed therein.

According to the second aspect of the invention, there is also provided a rotatable member for insertion into a body member, wherein the rotatable member comprises an enlarged portion releasably coupled thereto, which enlarged portion is arranged for engagement with a part of the body member to thereby attach the rotatable member to the body member such that the rotatable member is rotatable relative to the body member.

The rotatable member can also be provided with a driver attached thereto, as described with reference to the first aspect of the invention. The rotatable member can be coupled to a rotor for use in a PCP.

According to a third aspect of the invention, there is provided a progressive cavity pump comprising a fluid flow control apparatus for selectively controlling fluid flow through the progressive cavity pump and selectively diverting fluid flow around the progressive cavity pump.

The body member, rotatable member and fluid flow control apparatus of the second and third aspects of the invention can comprise any features of the apparatus described with reference to the first aspect of the invention, where applicable.

DESCRIPTION OF THE DRAWINGS

Embodiments of the present invention will now described by way of example only and with reference to the accompanying figures in which.

DESCRIPTION

Figure 1:
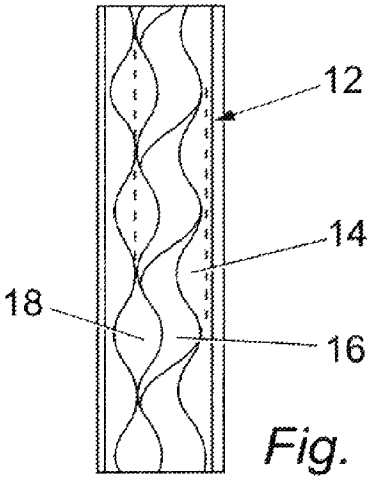
Fig. 1 Prior Art
FIG. 1 is a side view of a part of a progressive cavity pump.
Figure 2:
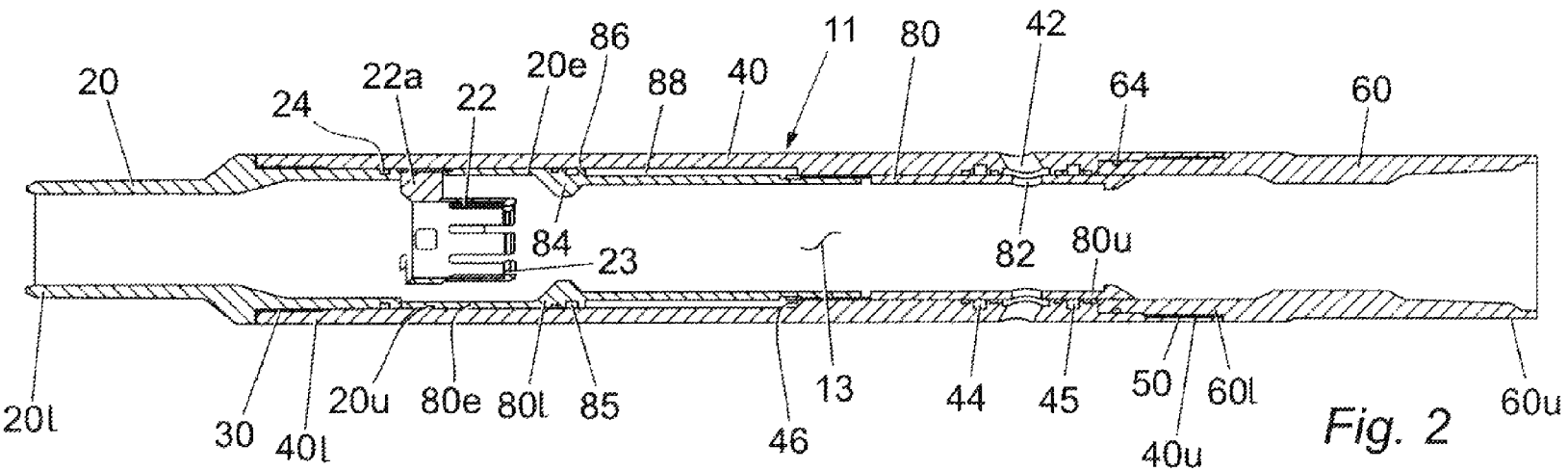
FIG. 2 is a sectional view of a body member of an apparatus according to a first aspect of the present invention.

A body member of the apparatus according to the invention is shown generally at 11 in FIG. 2. The body member 11 is substantially cylindrical and has a throughbore 13. The body member comprises a lower sub 20, a middle sub 40 and an upper sub 60.

A lower end 20L of the lower sub 20 is arranged to be coupled to production tubing (not shown) via a conventional screw threaded pin connection. The production tubing attached to the lower sub 20 typically extends to a hydrocarbon reservoir. A part of this production tubing is provided with the rubber stator 14 of the PCP 12 attached to an inner surface thereof. An upper end 60U of the upper sub 60 is also adapted to be connected to production tubing via a conventional screw threaded box connection such that hydrocarbons can be produced from the reservoir through the progressive cavity pump 12, the production tubing, the body member 11 and further production tubing up to the surface.

A substantially cylindrical latching device 22 is provided on the inner surface towards the upper end 20U of the bottom sub 20 where the latching device 22 is coupled to the sub 20 by means of three attachment points 22*a* (one of which is shown in FIG. 2) that project radially into the throughbore 13 from the inner surface of the lower sub 20. The latching device 22 has splines 23 provided at its upper end and a centrally disposed passageway to accommodate a rotatable member.

The upper end 20U of the lower sub 20 has a screw threaded pin connection that is arranged for insertion into a screw threaded box connection at a lower end 40L of the middle sub 40. At this connection point 30, the throughbore 13 is fluidly isolated from the exterior of the body member 11 by an annular seal 24 recessed into an outer surface of the pin connection at the upper end 20U of the lower sub 20.

The middle sub 40 is substantially cylindrical having box connections at its upper and lower ends 40U, 40L. An inner surface of the middle sub 40 is provided with an annular step 46 in a substantially centrally disposed location. Towards the upper end 40U, the middle sub 40 also has a plurality of downwardly extending bypass ports 42 formed through a sidewall thereof. The inner surface of the middle sub 40 adjacent the bypass ports 42 has recessed annular seals 44, 45 on either side thereof. The box connection at the upper end 40U engages with a pin connection at a lower end 60L of the upper sub 60. The ends 40U, 601 of the middle and upper subs 40, 60 are connected by a screw thread 50 and an outer surface of the lower end 60L is provided with an annular seal 64 to fluidly isolate the exterior of the body member 11 from the throughbore 13.

A moveable member 80 is coaxially located within the body member 11. The moveable member 80 is substantially cylindrical and, due to seal 85, is sealed against the inner surface of the body member 11 and is moveable in a direction parallel to a longitudinal axis of the body member 11. A lower end 80L of the moveable member 80 has an end face 80*e* that is shown in FIG. 2 in its second configuration abutting an end face of the lower sub 20. An inner surface of the moveable member 80 at its lower end 80L has a radial protrusion 84 that projects radially inwardly into the throughbore 13 of the body member 11. An outer surface of the moveable member 80 adjacent the radial protrusion 84 has an annular step 86. Openings 82 are provided through a sidewall towards an upper end 80U of the moveable member 80.

Movement of the movable member 80 is limited at its lower end by the end face 20*e* of the lower sub 20 and at an upper end by the annular step 46 of the middle sub 40 abutting the annular step 86 of the movable member 80. A spring 88 is retained in the chamber defined between the annular step 46, the annular step 86, the outer surface of the movable member 80 and the inner surface of the middle sub 40. The spring 88 biases the moveable member 80 into the configuration shown in FIG. 2 such that the end 80*e* of the movable member 80 abuts against the upper end face 20*e* of the bottom sub 20.

Figure 3:
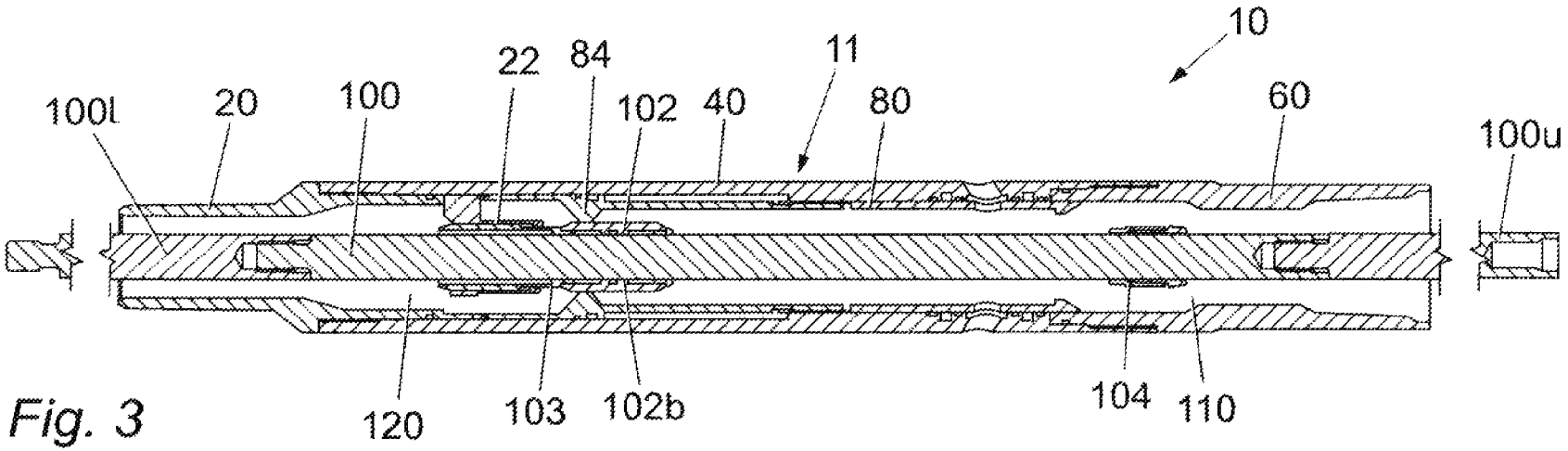
FIG. 3 is a sectional view of the apparatus of FIG. 2 having a rotatable member disposed therein in a second configuration.
Figure 4:
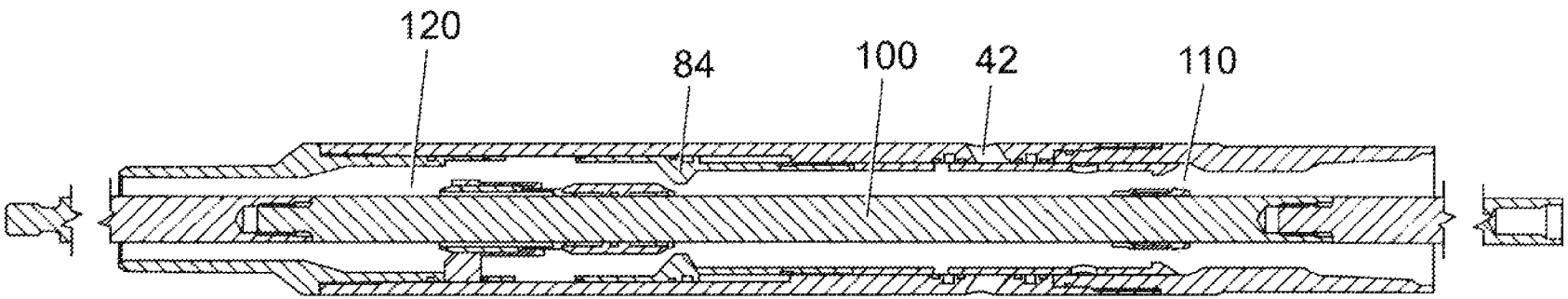
FIG. 4 is a sectional view of the apparatus of FIG. 3 in a first configuration.

A rotatable member in the form of a rod string 100 is shown in FIGS. 3 and 4. The rod string 100 is provided with a conventional steel rotor 16 at its lowermost end and can be rotated from surface as will be subsequently described. The presence of the rotatable member within the body member 11 forms an apparatus 10. Both the rod string 100 and the rotor 16 have an outer diameter less than the central passageway of the latching device 22 and are adapted to fit therethrough. The rod string 100 has a collar 102 arranged therearound. The collar 102 has a splined end 103 for engaging with the splines 23 provided on the latching device 22. The collar 102 also has an inner bearing surface 102*b* that allows rotation of the rod string 100 therethrough when the collar 102 is in its latched position engaged with the splines 23 of the latching device 22. A lower end 100L of the rod string 100 is coupled to the steel rotor 16 for insertion into the rubber stator 14 within the production tubing to thereby form the progressive cavity pump 12. An upper end 100U of the rod string 100 is coupled to a drive motor for driving rotation of the rod string 100. The presence of the rod string 100 within the throughbore 13 creates a first annular portion 110 that is an annular space between a part of the rod string 100 and the inner surface of the body member 11. A second annular portion 120 is also created between another part of the rotatable member 100 and the inner surface of the body member 11. FIG. 3 shows the apparatus 10 in its second configuration wherein the first annular portion 110 is in fluid communication with the bypass ports 42 in the middle sub 40, since the openings 82 of the movable member 80 are aligned therewith and the first annular portion 110 is obturated from the second annular portion 120 by the seal between the radial protrusion 84 and collar 102. FIG. 4 shows the apparatus 10 in a first configuration wherein the first annular portion 110 is in fluid communication with the second annular portion 120 and the bypass ports 42 are obturated by a sidewall of the moveable member 80.

Figure 5:
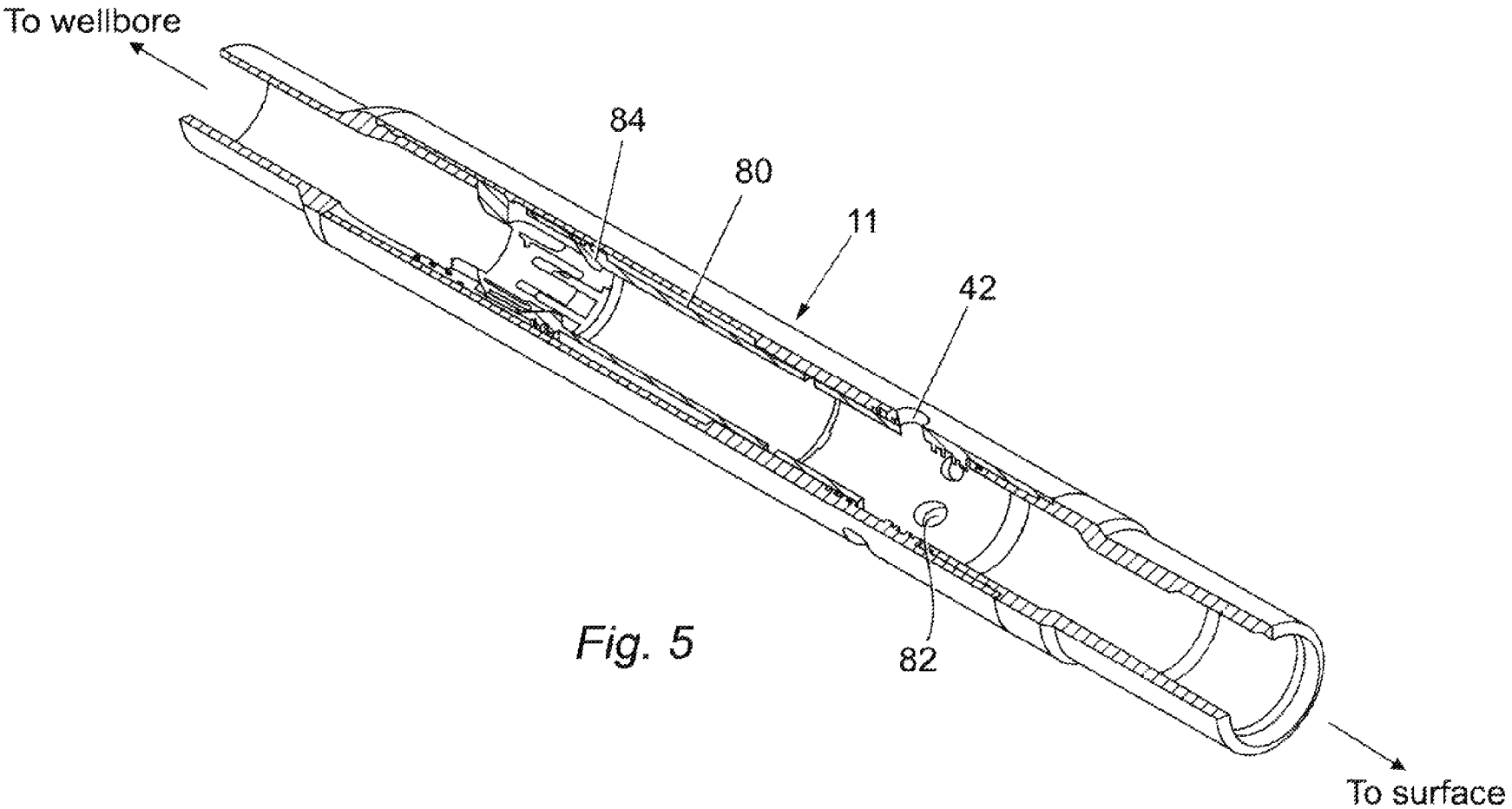
FIGS. 5-10 are perspective views of the apparatus of FIGS. 3 and 4 with a portion of the moveable member cut away and showing consecutive steps of the assembly and operation of the apparatus.

Before use of the apparatus 10, a lower end of the production tubing carrying the rubber stator 14 is positioned within a wellbore, with the body member 11 included in the tubing string downstream (vertically above) of the stator 14. The upper end of the body member 11 is attached to production tubing that leads to surface as shown in FIG. 5.

Figure 6:
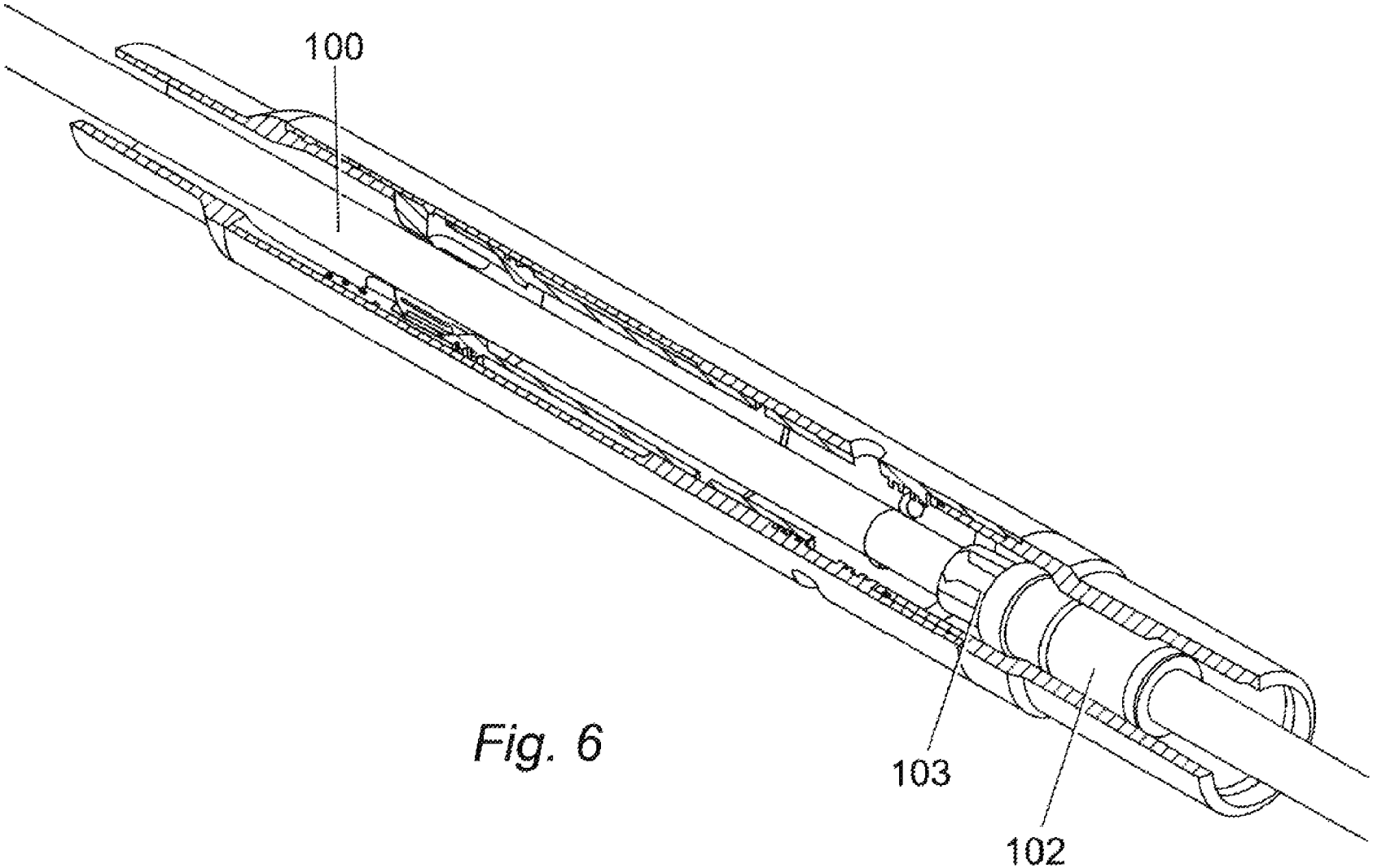
Figure 7:
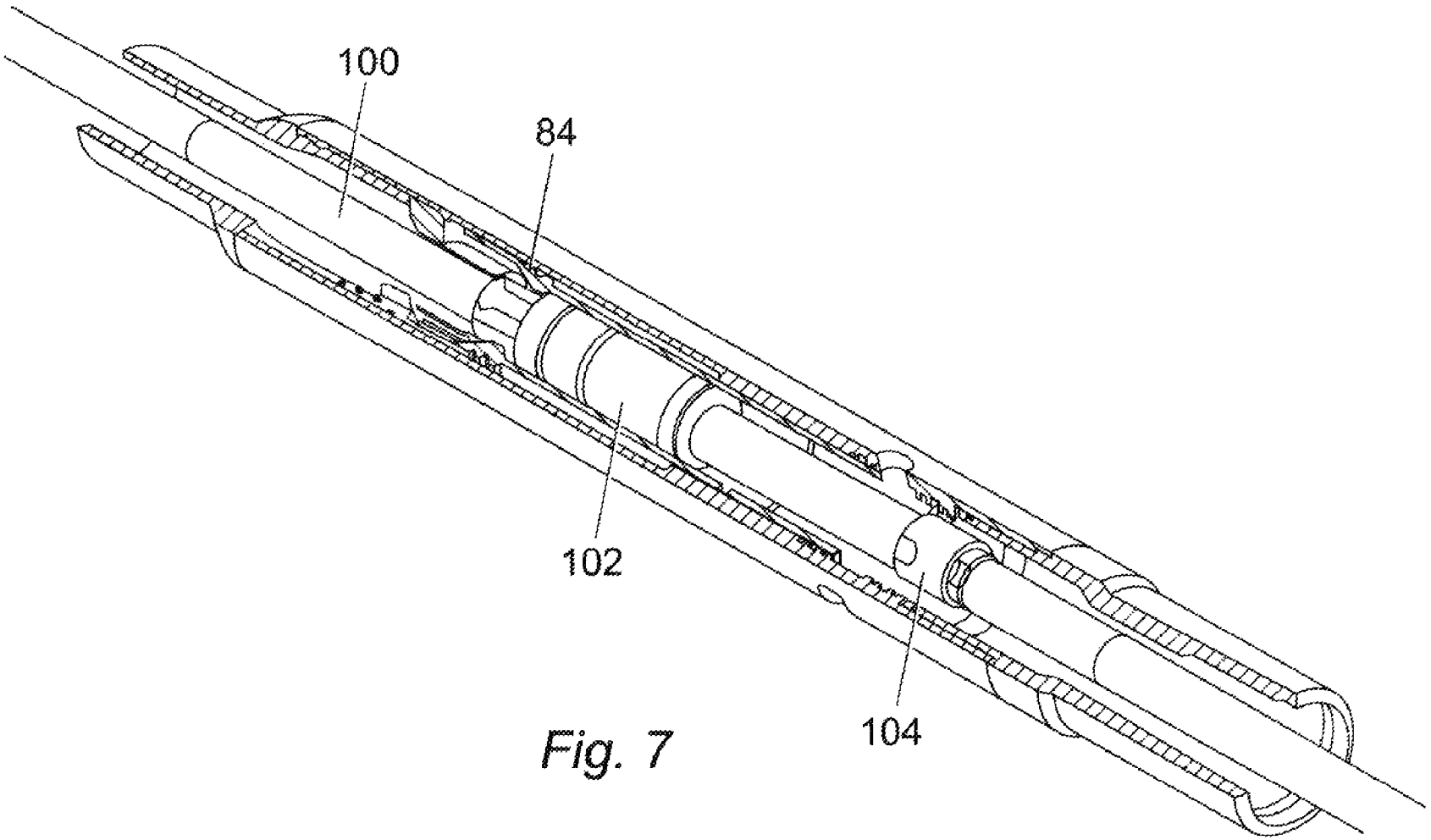
Figure 8:
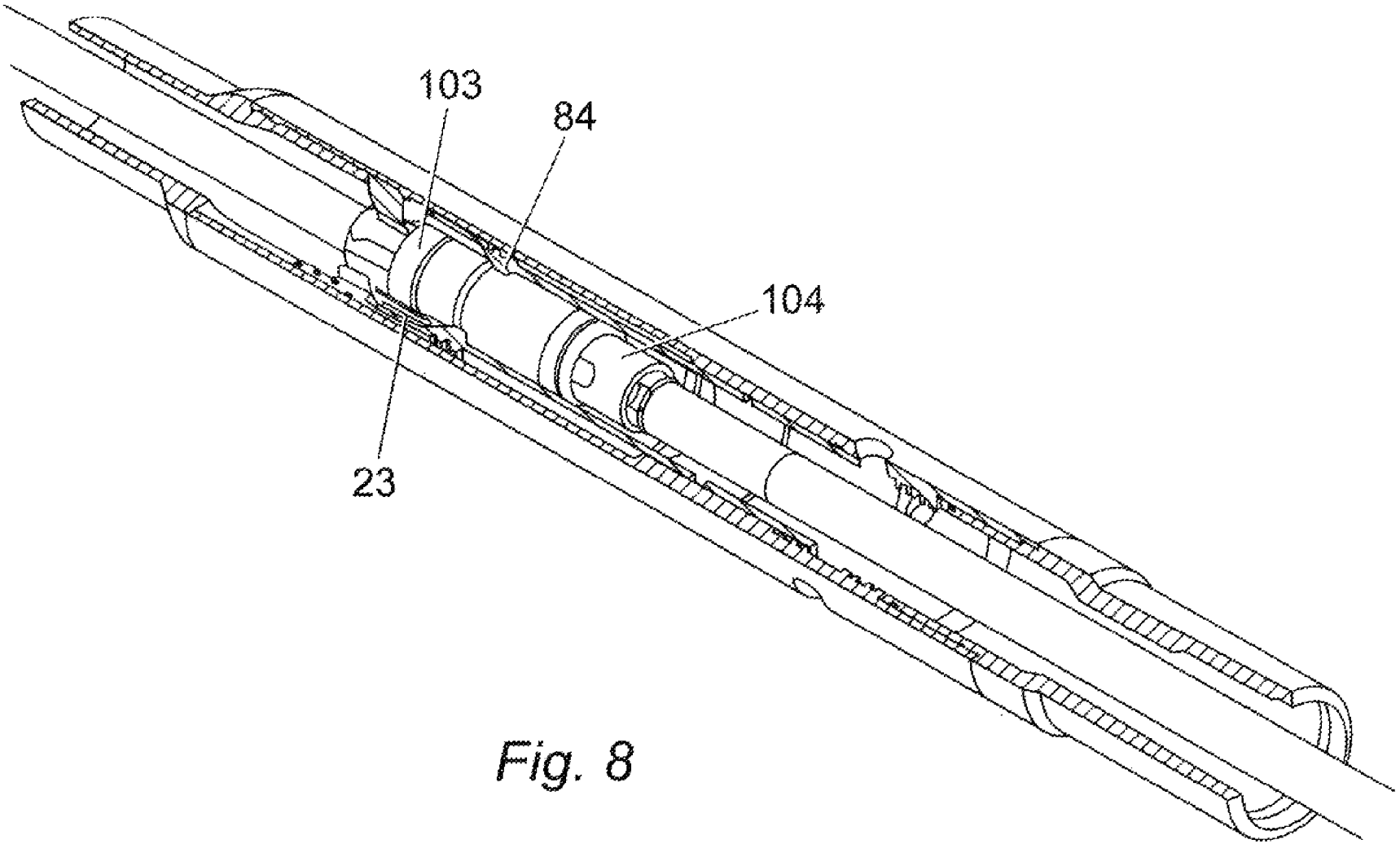
Figure 9:
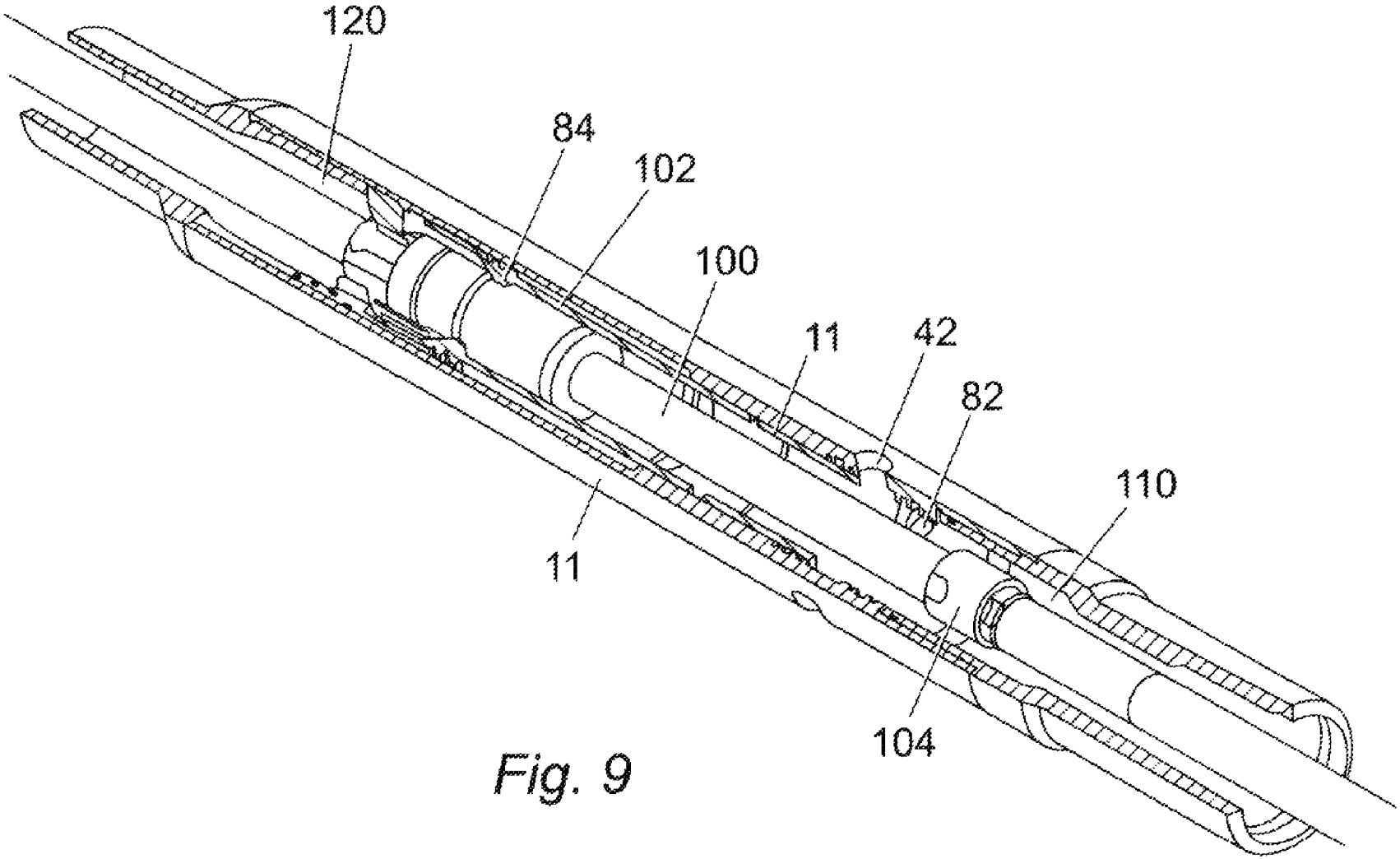
Figure 10:
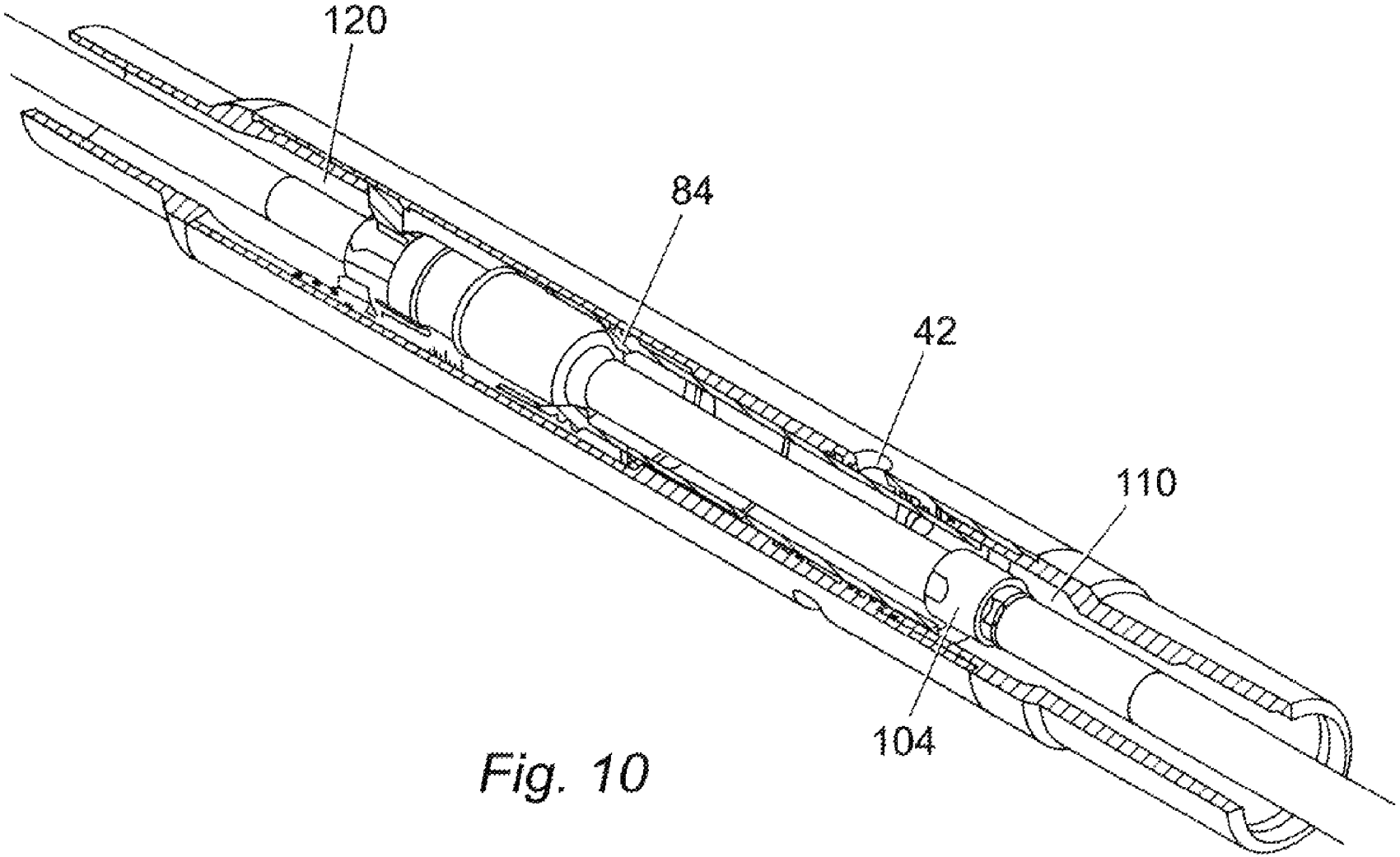

A rod string 100 commencing with the rotor 16 is fed through the body member 11 and the passageway in the latching device 22 until the collar 102 is located within the body member 11 (illustrated in FIG. 6). The splined portion 103 of the collar 102 latches with the splines 23 on the latch member 22 as shown in FIG. 7. The rod string 100 continues to be fed through the collar 102 until the hammer 104 contacts an upper end of the collar 102 to compression fit the latch device 22 and the collar 102 into secure engagement by driving the interfitting splines 23, 103 together (FIG. 8). The rod string 100 can then be backed off such that the hammer 104 is moved away from the collar 102 as shown in FIG. 9. The total length of the rod string 100 below the collar 102 is calculated such that the rotor 16 is correctly positioned within the stator 14. The spring 88 ensures that the default position of the apparatus 10 is in a second or closed configuration to allow flow from the first annular portion 110 through the opening 82 in the sidewall of the moveable member 80 and the bypass ports 42 in the sidewall of the middle sub 40.

Fluids and hydrocarbons can be produced naturally from the reservoir, (through the second fluid flow path) if the well pressure is sufficient to overcome the hydrostatic head following installation of the PCP 12 and apparatus 10. Since the moveable member 80 is biased into the second configuration, the rod string 100 can be held against rotation so that the PCP 12 is inactive and fluids can be produced from the reservoir, through the bypass ports 42, the openings 82 and the first annular portion 110. Thus, the apparatus 10 provides a fluid flow path that circumvents the pump 12, when the moveable member 80 is in the second or closed configuration.

When it is required to provide fluid such as hydrocarbons from the wellbore with artificial lift (for example, when the natural well pressure drops), the progressive cavity pump 12 is activated by driving rotation of the rod string 100 from the surface. This causes the rotor 16 to turn within the stator 14 thereby positively displacing fluids within cavities 18 and providing the fluids such as hydrocarbons with the necessary lift to overcome the hydrostatic head. Following actuation of the progressive cavity pump 12, hydrocarbons are lifted through the annulus and enter the (second) annular portion 120. The hydrocarbon flow acts on the lower face of the protrusion 84 and creates a pressure differential across the protrusion 84. Above a predetermined level, the pressure overcomes the biasing of the spring 88 at which point the moveable member 80 is pushed upwardly within the body member 11. Upward movement of the moveable member 80 causes the bypass ports 42 in the middle sub 40 to be obturated by the sidewall of the moveable member 80 and thus the first annular portion 110 is no longer in fluid communication with the bypass ports 42. Once the radial protrusion 84 clears the collar 102, the protrusion 84 no longer acts as an impediment to fluid flow within the annulus and there is fluid communication between the second or lower annular portion 120 and the first or upper annular portion 110. Therefore, hydrocarbons can be produced through the annulus 110, 120 when the progressive cavity pump 12 is in use.

Should the progressive cavity pump 12 cease to function, hydrocarbons are no longer displaced upwardly within the annulus 110, 120 and there is no lift to overcome the hydrostatic head. As a result, the urging of the spring 88 becomes the dominant force acting on the moveable member 80 and the moveable member 80 returns to its default position under the urging of the spring 88 such that the radial protrusion 84 contacts the collar 102 and the openings 82 in the side wall of the moveable member 80 are once again positioned adjacent the bypass ports 42 to open the second fluid flow path and bypass the pump 12.

The invention allows fluids to circumvent the progressive cavity pump 12 without the conventional removal of the rotor 16 and consequent downtime in the wellbore. As a result of the apparatus 10 according to the invention certain procedures are facilitated. For example, chemicals, well treatments, etc. can be injected through the second fluid flow path into the reservoir by passing the progressive cavity pump 12. Additionally, the invention has the advantage that once the progressive cavity pump 12 is no longer in use, the second fluid flow path allows sand downstream of the pump 12 to travel through the bypass ports 42 by means of gravity fall back, such that the sand settles outwith the production tubing and without creating a sand plug above the progressive cavity pump 12.

Modifications and improvements can be made without departing from the scope of the invention.

The invention claimed is:

1. Apparatus for selectively controlling fluid flow downhole in conjunction with a progressive cavity pump (PCP), the apparatus comprising:

a body member having a throughbore formed therein;

at least one bypass port formed in the body member;

a rotatable member arranged for insertion and rotation within the throughbore of the body member thereby creating first and second annular portions, wherein the rotatable member is located in use vertically above the PCP and is coupled to a rotor thereof such that rotation of the rotatable member rotates the rotor of the PCP;

a moveable member;

wherein the moveable member is moveable between a first configuration which defines a first fluid flow path between the first and second annular portions and a second configuration which defines a second fluid flow path between the first annular portion and the at least one bypass port; and wherein the moveable member translates from the second configuration to the first configuration when the PCP is activated and remains in the first configuration whilst the PCP remains in operation.

2. The apparatus according to claim 1, wherein the moveable member is moveable between the first and second configurations in response to fluid flow along the first fluid flow path.

3. The apparatus according to claim 1, wherein the moveable member is biased by a resilient device towards the second configuration.

4. The apparatus according to claim 1, wherein the body member has an inner surface and the movable member comprises a cylindrical sleeve slidably coupled to the inner surface of the body member and movable relative thereto.

5. The apparatus according to claim 1, wherein the moveable member is arranged in the first configuration to permit fluid flow in the first fluid flow path and substantially restrict fluid flow in the second fluid flow path.

6. The apparatus according to claim 1, wherein the moveable member is adapted to open the at least one bypass port when in the second configuration and to obturate the at least one bypass port when in the first configuration.

7. The apparatus according to claim 1, wherein the moveable member comprises a sleeve having a sidewall and at least one opening provided in the sidewall.

8. The apparatus according to claim 7, wherein the at least one opening is aligned with the at least one bypass port in the second configuration and the sidewall of the sleeve obturates the at least one bypass port in the first configuration.

9. The apparatus according to claim 1, wherein the moveable member is adapted to close the annulus between the first and second annular portions when in the second configuration and to permit fluid flow in the annulus between the first and second annular portions when in the first configuration.

10. The apparatus according to claim 9, wherein the moveable member comprises a protrusion extending radially into the annulus.

11. The apparatus according to claim 10, wherein the rotatable member comprises an enlarged portion such that translation of the moveable member into the second configuration results in movement of the radial protrusion of the moveable member into contact with the enlarged portion of the rotatable member to substantially close the annulus therebetween.

12. The apparatus according to claim 10, wherein the radial protrusion of the moveable member only permits flow of fluid through the second annular portion when the at least one bypass port is substantially obturated by the sidewall of the moveable member.

13. Apparatus according to claim 1, the moveable member comprises a protrusion extending radially into the annulus between the first and second annular portions; and wherein the radial protrusion is arranged such that fluid flow acts on a face of the radial protrusion to maintain the movable member in the first configuration when the fluid exerts a force on the face that is above a predetermined force.

14. The apparatus according to claim 1, wherein the apparatus is further provided with a latch device for correctly positioning the rotatable member relative to the body member.

15. The apparatus according to claim 14, wherein the latch device comprises corresponding engagement portions provided on the body member and the rotatable member.

16. The apparatus according to claim 15, wherein the rotatable member is rotatable relative to the engagement portion provided on the rotatable member.

17. The apparatus according to claim 15, wherein the rotatable member is provided with a driver for driving the engagement portions of the rotatable member and the body member into secure engagement with one another.

18. The apparatus according to claim 17, wherein the driver further provides an indicator for positioning the rotor correctly into the stator.

19. The apparatus according to claim 1, wherein the apparatus comprises a first seal area that is adapted to seal the at least one bypass port from the first annular portion when the moveable member is in the first configuration.

20. The apparatus according to claim 1, wherein the apparatus comprises a second seal area that is adapted to seal the annulus between the first and second annular portions when the moveable member is in the second configuration.

21. The apparatus according to claim 20, wherein the second seal area comprises an annular sliding seal provided on an outer surface of the radial protrusion.

22. A progressive cavity pump (PCP) comprising a fluid flow control apparatus for selectively controlling fluid flow through the PCP and selectively diverting fluid flow around the PCP, wherein the apparatus for selectively controlling fluid flow is according to claim 1.

23. Apparatus for selectively controlling fluid flow downhole in conjunction with a progressive cavity pump (PCP), the apparatus comprising:

a body member having a throughbore formed therein;

at least one bypass port formed in the body member;

a rotatable member arranged for insertion and rotation within the throughbore of the body member thereby creating first and second annular portions, wherein the rotatable member is located in use vertically above the PCP and is coupled to a rotor thereof such that rotation of the rotatable member rotates the rotor of the PCP;

a moveable member;

wherein the moveable member is moveable between a first configuration which defines a first fluid flow path between the first and second annular portions and a second configuration which defines a second fluid flow path between the first annular portion and the at least one bypass port;

wherein the moveable member comprises a protrusion extending radially into the annulus; and wherein the radial protrusion is arranged such that fluid flow acts on a face of the radial protrusion to maintain the movable member in the first configuration when the fluid exerts a force on the face that is above a predetermined force.

24. Apparatus for selectively controlling fluid flow downhole in conjunction with a progressive cavity pump (PCP), the apparatus comprising:

a body member having a throughbore formed therein;

at least one bypass port formed in the body member;

a rotatable member arranged for insertion and rotation within the throughbore of the body member thereby creating first and second annular portions;

a moveable member;

wherein the moveable member is moveable between a first configuration which defines a first fluid flow path between the first and second annular portions and a second configuration which defines a second fluid flow path between the first annular portion and the at least one bypass port;

wherein the rotatable member is coupled in use to the PCP; and wherein the moveable member translates from the second configuration to the first configuration when the pump is activated and remains in the first configuration whilst the PCP remains in operation.

25. The apparatus according to claim 24, wherein the rotatable member is coupled at one end to a rotor for use in a progressive cavity pump.

26. The apparatus according to claim 25, wherein the rotatable member is coupled at another end to a motor for driving rotation of the rotatable member.

27. The apparatus according to claim 24, wherein an end of the body member is coupled to tubing having a stator disposed therein.

28. A method of controlling fluid flow downhole in conjunction with a progressive cavity pump (PCP) comprising the steps of:

providing a body member having a bypass port and a throughbore;

inserting a rotatable member within the throughbore of the body member and thereby providing a first fluid flow path between a first annular portion and a second annular portion between the body member and the rotatable member and a second fluid flow path between the first annular portion and the bypass port in the body member;

locating the rotatable member vertically above the PCP and coupling the rotatable member to a rotor thereof such that rotation of the rotatable member rotates the rotor of the PCP;

providing a moveable member that is moveable between a first configuration in which flow is directed along the first flow path and a second configuration in which flow is directed along the second flow path;

wherein the moveable member moves between the first and second configurations in response to fluid flow along the first fluid flow path, wherein the moveable member translates from the second to the first configuration when the PCP is activated and remains in the first configuration whilst the PCP remains in operation.

29. The method according to claim 28, including diverting the flow of fluid between the first and second flow paths and moving the moveable member in response to fluid flow conditions within a downhole wellbore.

30. The method according to claim 28, including controlling the flow of any fluid selected from the group consisting of: naturally produced fluids; injected fluids; and pumped produced fluids downhole.

31. The method according to claim 28, including moving and maintaining the moveable member in the first configuration when there is sufficient fluid flow along the first fluid flow path and moving and maintaining the moveable member in the second configuration when there is insufficient fluid flow along the first fluid flow path.

32. The method according to claims 28, including moving the moveable member in response to a pressure differential within the throughbore.

33. The method according to claim 28, including moving the moveable member in response to a pressure differential between the first and second annular portions.

34. The method according to claim 28, including biasing the movable member towards the second configuration.

35. The method according to claim 28, including latching the rotatable member in a predetermined position relative to the body member.

36. A system for selectively controlling fluid flow downhole in conjunction with a progressive cavity pump (PCP), the system comprising a body member for use with a rotatable member, wherein the body member has a throughbore for receiving a rotatable member and a sidewall and at least one bypass port formed through the sidewall of the body member;

wherein the body member is further provided with a moveable member that is moveable between a first configuration in which the bypass port(s) are substantially obturated and a second configuration in which the bypass port(s) are in fluid communication with the throughbore;

wherein the body member is coupled to tubing having a stator for use in the PCP formed therein;

wherein the moveable member has an inwardly projecting shoulder that is adapted to obturate the throughbore when the moveable member is in the second configuration;

and wherein the moveable member is moved by fluid, when the PCP is activated, to translate to the first configuration.

37. The system according to claim 36, wherein the moveable member is coaxial with the body member and sealed thereagainst.

38. A rotatable member for insertion into a body member, the rotatable member being coupled to a rotor for use in a progressive cavity pump (PCP), wherein the rotatable member comprises an enlarged portion releasably coupled thereto, which enlarged portion is arranged for engagement with a part of the body member to thereby selectively attach the rotatable member to the body member such that the rotatable member is rotatable relative to the body member;

wherein the enlarged portion is located around an outer surface of a section of the rotatable member such that the rotatable member passes all way through and out both ends of the enlarged portion;

wherein the body member is coupled to tubing having a stator for use in the PCP formed therein;

wherein the rotatable member and the enlarged portion are rotatable with respect to each other; and wherein the rotatable member includes a driver for driving engagement portions provided on the rotatable member and the body member into secure engagement with one another.

39. The rotatable member according to claim 38, wherein the engagement portions provided on the rotatable member are provided on the enlarged portion.

40. The rotatable member according to claim 38, the driver comprises a rigid band attached to the rotatable member that is capable of contacting and driving the engagement portions into secure engagement with one another.

41. The rotatable member according to claim 38, wherein the rotatable member is coupled at one end to the rotor and at another end to a motor for driving rotation of the rotatable member.

42. The rotatable member according to claim 38, wherein the driver further provides an indicator for positioning the rotor correctly into the stator.

* * * * *